US005139127A

United States Patent [19]

Ficken et al.

[11] Patent Number: 5,139,127

[45] Date of Patent: Aug. 18, 1992

[54] BEVERAGE DISPENSER DETECTING MECHANISM

[75] Inventors: Leonard A. Ficken, Manchester; Mark S. Schmitz, St. Charles, both of Mo.

[73] Assignee: Unidynamics Corporation, New York, N.Y.

[21] Appl. No.: 769,469

[22] Filed: Oct. 1, 1991

[51] Int. Cl.[5] ..... G07F 13/10; B67D 3/02

[52] U.S. Cl. ..... 194/239; 222/2; 222/129.1; 141/1; 141/98

[58] Field of Search ..... 194/239, 240, 241, 243; 222/2, 129.1, 146.1, 146.2, 146.5, 146.6; 141/1, 2, 94, 98

[56] References Cited

U.S. PATENT DOCUMENTS

| | | | |
|---|---|---|---|
| 2,972,434 | 2/1961 | James | 194/240 X |
| 3,021,685 | 2/1962 | Gore et al. | 222/2 X |
| 3,221,859 | 12/1965 | McAbee | 222/2 X |
| 3,375,913 | 4/1968 | Norris, Jr. | 194/240 |
| 3,578,126 | 5/1971 | Adams | 194/239 X |
| 4,469,150 | 9/1984 | Grimaldi | 141/95 |
| 4,478,357 | 10/1984 | Jenkins | 222/129.1 X |
| 4,519,428 | 5/1985 | Moody | 141/98 |
| 4,590,975 | 5/1986 | Credle, Jr. | 141/1 |
| 4,645,093 | 2/1987 | Jones | 221/93 |
| 4,728,005 | 3/1988 | Jacobs et al. | 222/129.1 X |
| 4,944,332 | 7/1990 | Belland | 141/1 |
| 4,951,719 | 8/1990 | Wiley et al. | 141/1 |
| 4,967,808 | 11/1990 | Credle, Jr. et al. | 141/9 |
| 4,971,120 | 11/1990 | Credle, Jr. et al. | 141/174 |
| 4,972,883 | 11/1990 | Hassell et al. | 141/1 |
| 4,974,643 | 12/1990 | Bennett et al. | 141/1 |
| 5,027,698 | 7/1991 | Chirnomas | 222/146.1 X |

*Primary Examiner*—Frank E. Werner
*Assistant Examiner*—Scott L. Lowe
*Attorney, Agent, or Firm*—Senniger, Powers, Leavitt & Roedel

[57] ABSTRACT

A beverage dispensing machine is provided and is of the type having a cup station, a cup holder for holding a plurality of cups, a cup delivery for delivering one of the cups at a time to the cup station, a beverage dispenser for dispensing beverage to the cup station, and controller for controlling operation of the cup delivery and the beverage dispenser. The controller being adapted to initiate a cycle of operation of the machine upon activation of the controller wherein the cup delivery delivers a cup to the cup station from the cup holder and the beverage dispenser dispenses a predetermined quantity of beverage to the cup in the cup station. The improvement comprises a detecting mechanism for engaging and detecting the presence of a container inserted into the cup station prior to activation of the controller. The container detecting mechanism being adapted to modify the cycle of operation of the machine such that upon activation of the controller the cup delivery does not deliver a cup to the cup station and the beverage dispenser delivers a predetermined quantity of beverage to the container inserted in the cup station.

9 Claims, 7 Drawing Sheets

BEVERAGE DISPENSER DETECTING MECHANISM

BACKGROUND OF THE INVENTION

The present invention relates generally to beverage dispensing machines and more particularly to a beverage dispensing machine having a detecting device capable of engaging and detecting the presence of a mug or the like manually inserted into a vending machine cup station by a user.

Presently, there are vending machines of the type having a beverage dispenser and a cup dispenser storing a supply of cups capable of dispensing a cup made from paper or plastic into a cup station for receiving the cup. In this type of vending machine, after a person selects a beverage, a cup is automatically dropped from the cup dispenser into the cup station where the selected beverage is then dispensed into the cup. After this process is completed, the purchaser may then reach into the cup station and retrieve the beverage.

From an ecological standpoint, this type of vending machine may be dissatisfying. Disposable goods such as paper cups are now being replaced by reusable goods. Additionally, purchasers may wish to drink from their own mug or cup. There is presently a need for a vending machine that gives the purchaser an option of substituting their own reusable mug or cup in place of the disposable cup that is automatically provided by the typical vending machine.

Although there has been an attempt in the past to achieve this result it has not provided a satisfactory device. In that device a light source and light sensor arrangement was used to detect the insertion of a user's cup into the cup station of the machine. However, due to spillage and the like the light and sensor often became inoperative and a cup from the machine's cup dispensor was allowed to drop into the cup station producing an unsatisfactory result.

Furthermore, with such prior art device there was no incentive for a customer to use his or her own cup to help reduce cup usage for conservation reasons.

SUMMARY OF THE INVENTION

The above referred to problems and disadvantages of prior art devices are overcome by the present invention through the provision of an electro/mechanical sensing mechanism to sense insertion of the customer's mug or cup, and by the provision of a discount from the normal purchase price of a drink from the machine when the customer uses his or her own cup.

Among the several objects of this invention may be noted the provision of a beverage dispensing machine which detects by engagement the presence of a mug inserted in the machine so that beverage is delivered to the mug; the provision of such a beverage dispensing machine that remits to the purchaser a discount when a mug or a cup is placed in the cup station; and the provision of such a beverage dispensing machine that provides an ecological benefit.

Generally, a beverage dispensing machine constructed according to the principles of the present invention is a beverage dispensing machine of the type having a cup station, means for holding a plurality of cups, means for delivering one of the cups at a time to the cup station, means for dispensing beverage to the cup station, and control means for controlling operation of the cup delivery means and the beverage dispensing means. The control means being adapted to initiate a cycle of operation of the machine upon activation of the control means wherein the cup delivery means delivers a cup to the cup station from the cup holding means and the beverage dispensing means dispenses a predetermined quantity of beverage to the cup in the cup station. The improvement comprises means engageable with a container inserted into the cup station for detecting the presence of a container inserted into the cup station prior to activation of the control means. The container detecting means being adapted to modify the cycle of operation of the machine such that upon activation of the control means the cup delivery means does not deliver a cup to the cup station and the beverage dispensing means delivers a predetermined quantity of beverage to the container inserted in the cup station.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
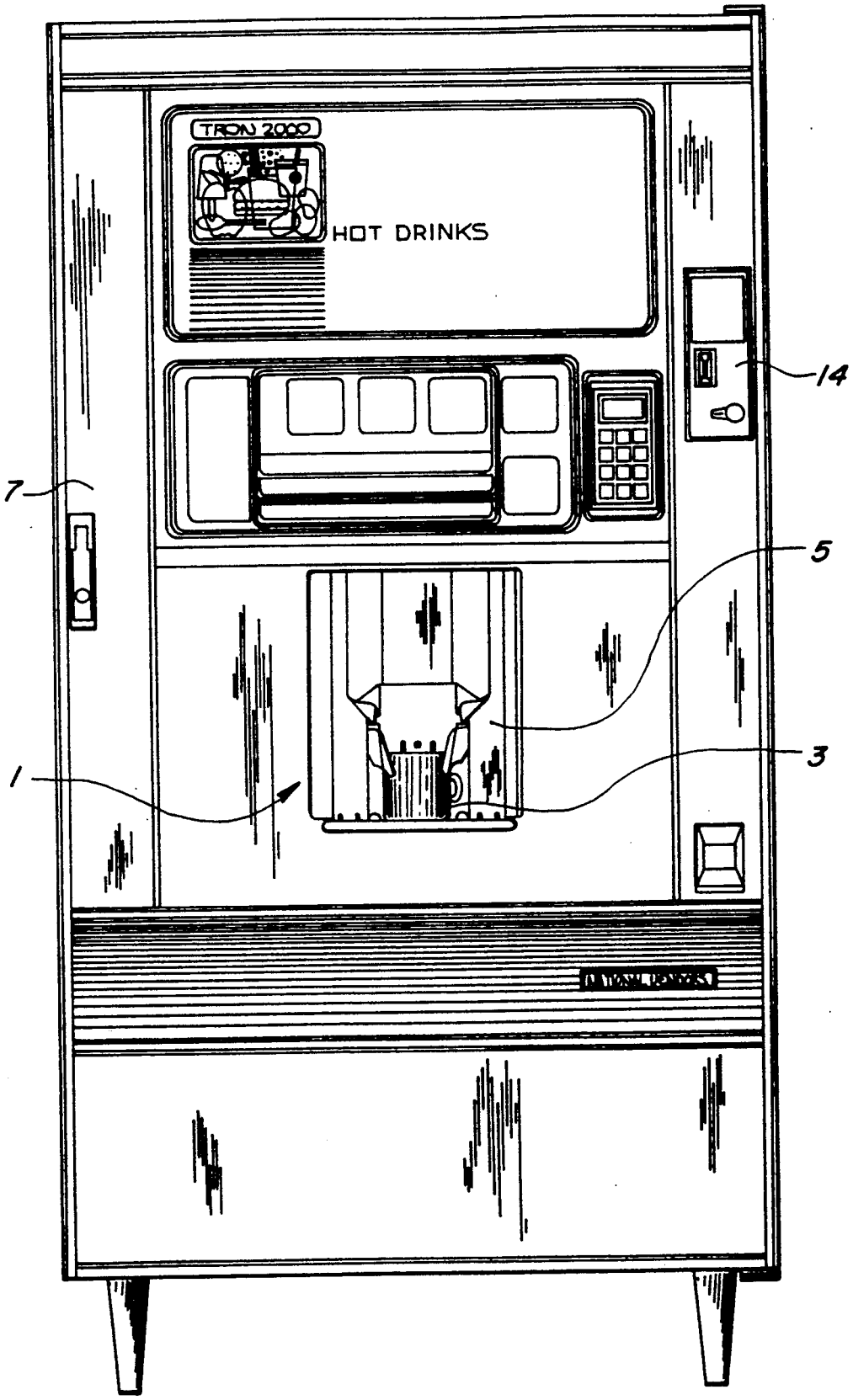
FIG. 1 is a front elevation of a vending machine incorporating a beverage dispenser detecting mechanism.
Figure 2:
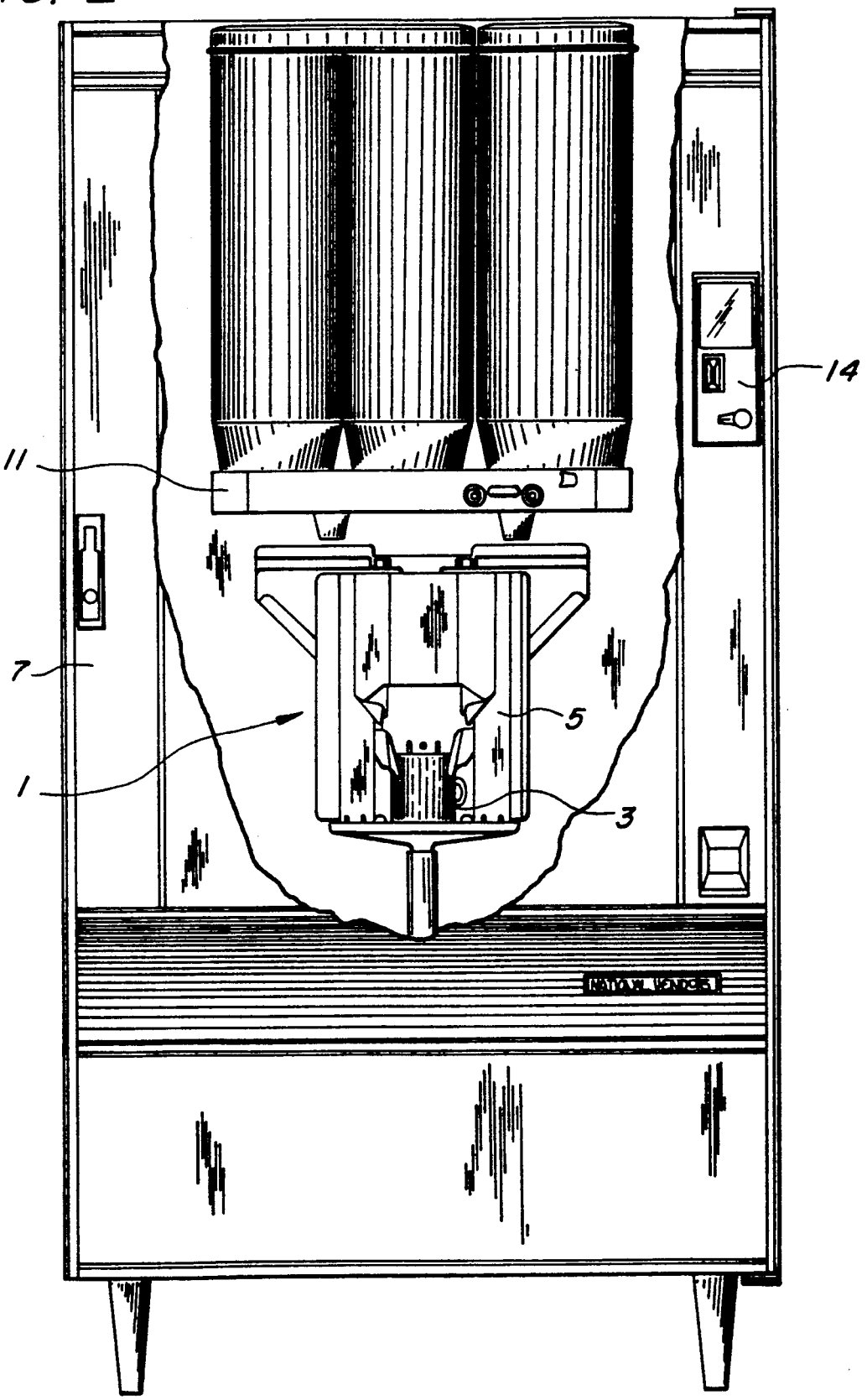
FIG. 2 is a front elevation of a vending machine as shown in FIG. 1 with a cut out revealing the detecting mechanism of the present invention.

Referring now to the drawings, there is generally indicated at 1 a beverage dispensing machine with a container detecting mechanism of the present invention which is capable of engaging and detecting the presence of a container or mug 3 manually inserted in a cup station 5 of a beverage dispensing or vending machine 7 (see FIGS. 1 and 2). Vending machine 7 is of the type having a beverage dispenser 9 (see FIG. 3) and a cup dispenser 11 adapted for delivering one of the cups at a time to the cup station 5 and for storing a supply of disposable cups. Generally, cup dispenser 11 contains a supply of disposable cups and is located above cup station 5 so that a disposable cup is dropped in a downward direction into cup station 5. Leading into beverage dispenser 9 may be a plurality of beverage flavors or syrups which are selectively mixed with carbonated water as is well known in the art (not shown). However, the beverage may also be coffee or something non-carbonated as is shown in the preferred embodiment. A control means 12 is provided for controlling the operation of the cup dispenser 11 and the beverage dispenser 9 (see FIG. 7). Control means 12 is adapted to initiate a cycle of operation of vending machine 7 upon activation of the control means 12 in which the cup dispenser 11 delivers a cup to the cup station 5 and the beverage dispenser 9 dispenses a predetermined quantity of beverage to the cup in the cup station 5. Activation of control means 12 is determined by satisfying a predetermined amount of currency in a currency receiver 14. Once satisfied, the cycle of operation begins.

Figure 3:
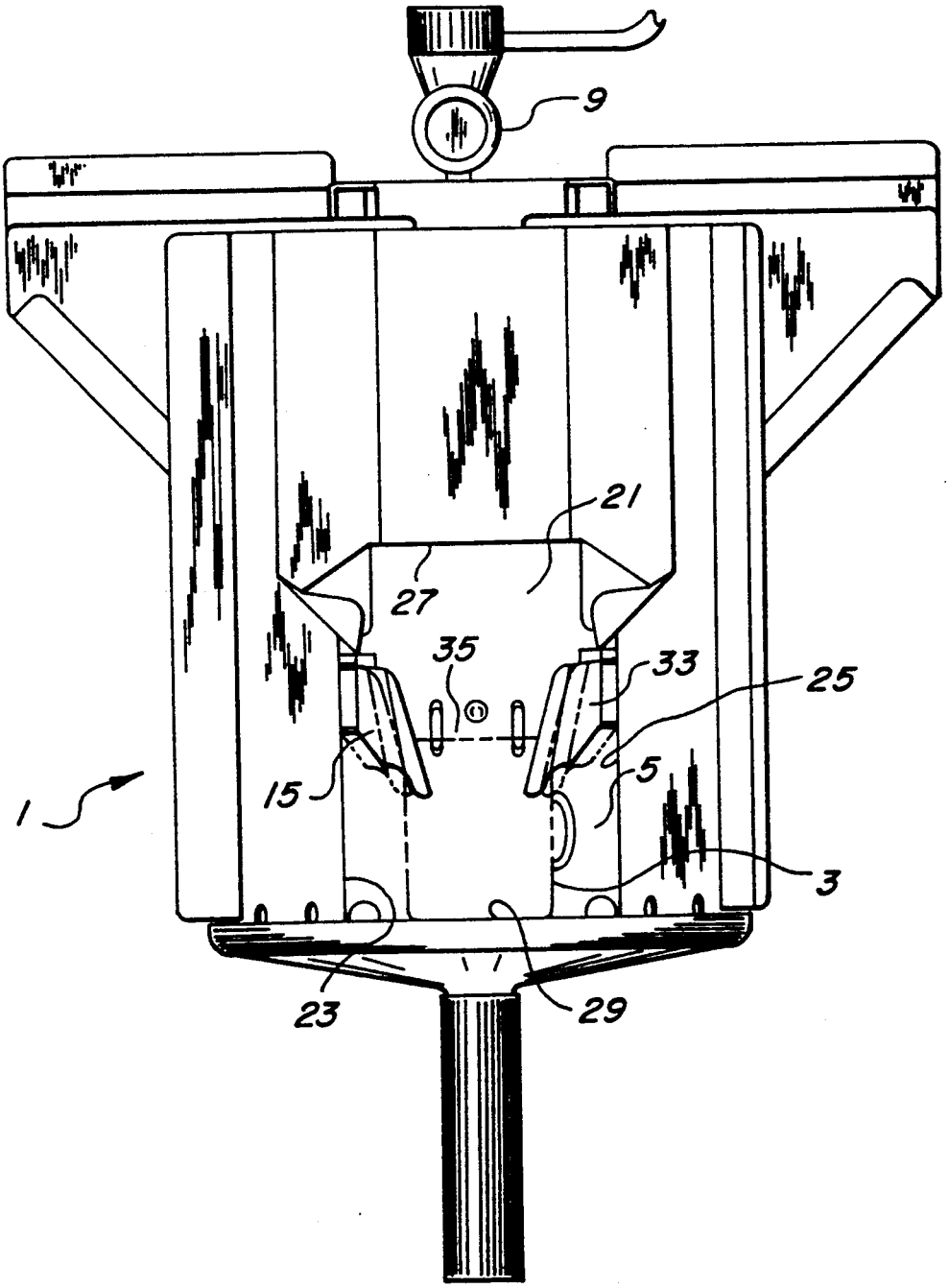
FIG. 3 is a front elevation of a cup station.
Figure 4:
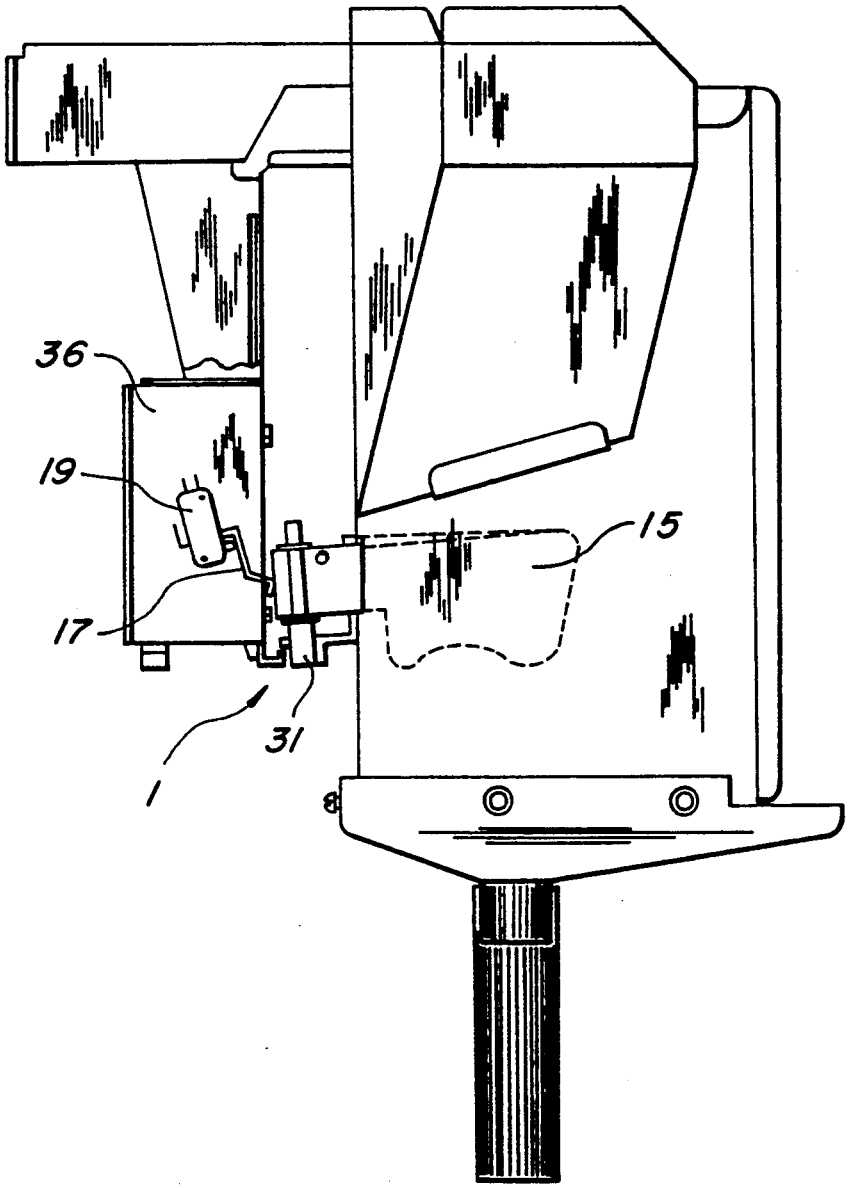
FIG. 4 is a side elevation of a cup station.
Figure 5:
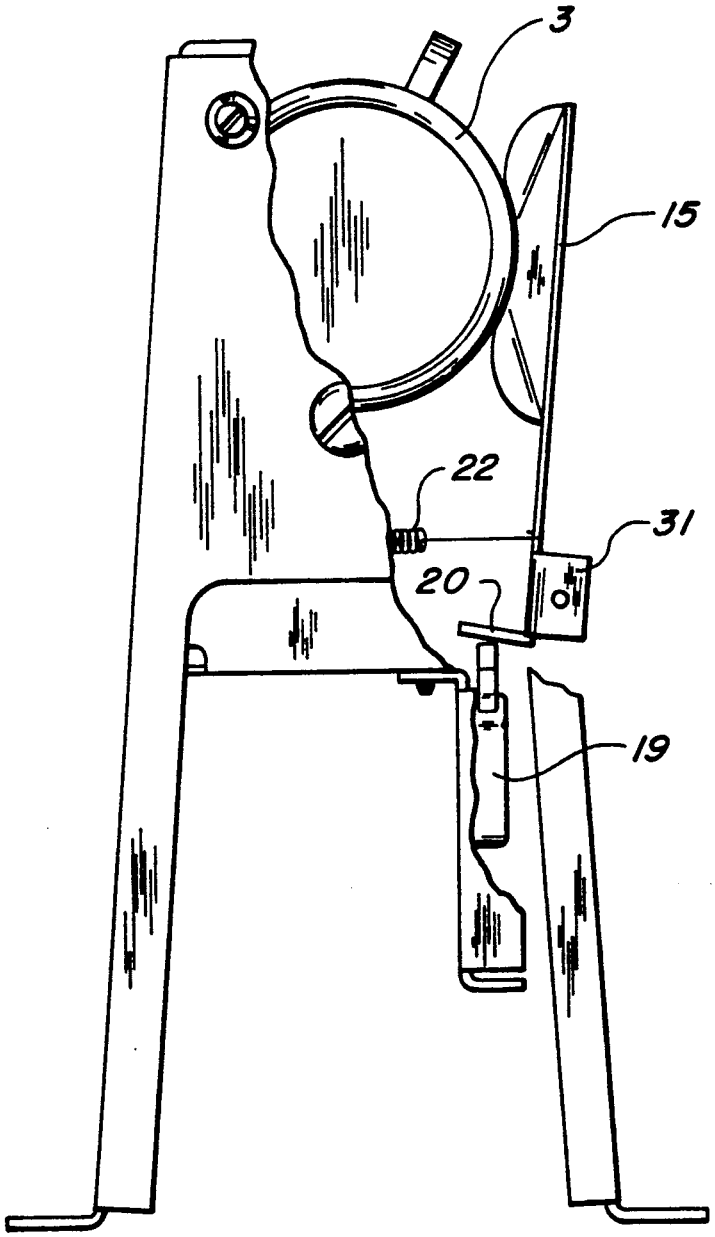
FIG. 5 is a top plan of a cup station.
Figure 6:
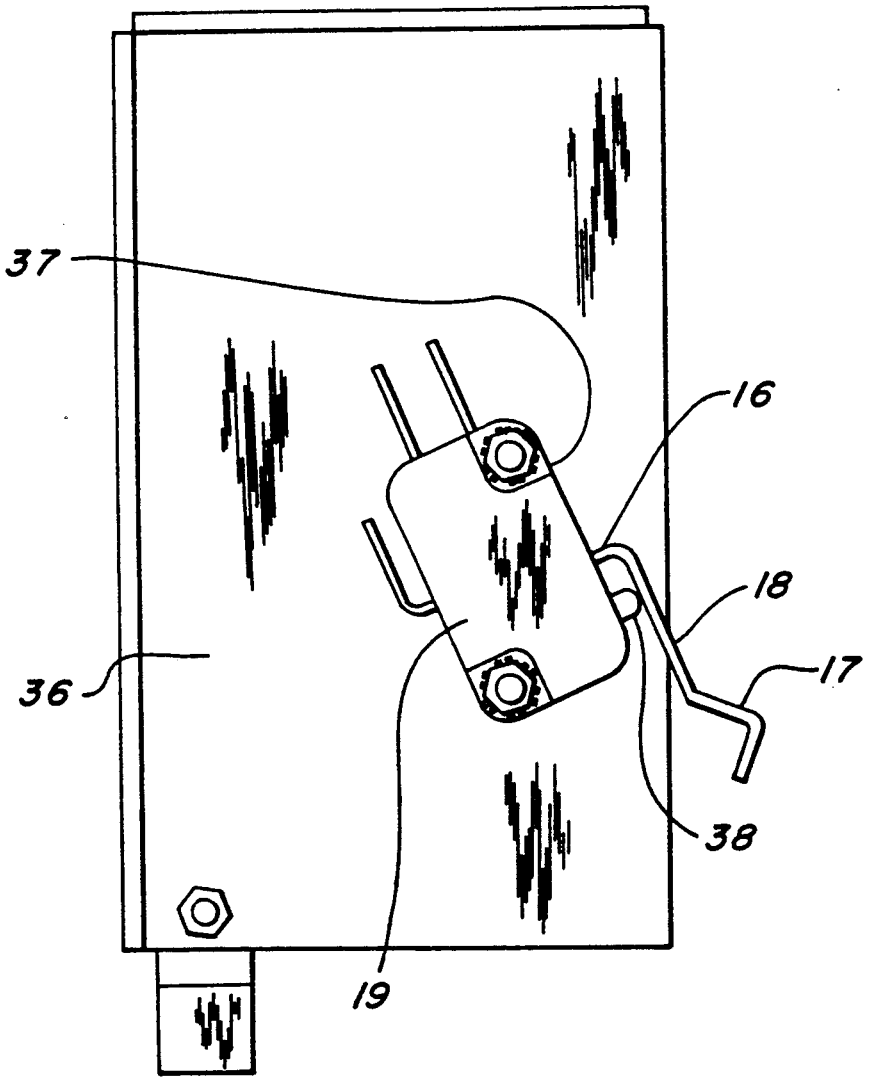
FIG. 6 is a switch of the present invention.

Detecting mechanism 1 is engaged by a mug 3 manually inserted in the cup station 5. Upon engaging and detecting the mug 3, detecting means 1 prevents the dispensing of a disposable cup into cup station 5. Therefore, the chosen beverage is allowed to flow into the manually inserted mug 3. In its preferred embodiment, the engagement means used to engage mug 3 is a cup deflector 15. As shown in FIG. 3, cup deflector 15 is constructed for deflecting cups dispensed by cup dispenser 11 into cup station 5. Cup deflector 15 is pivotly mounted so that it engages and moves away from mug 3 when it is placed in cup station 5. When moved, cup deflector 15 releases switch lever 17 (see FIGS. 4, 5 and 6). Upon releasing lever 17, switch 19 is activated and sends a signal to a control means 12. The control means 12 is responsive to the signal to instruct cup dispenser 11 to not drop a disposable cup into cup station 5.

Referring now to FIG. 3, cup station 5 comprises a back wall 21, two side walls 23, 25, a top 27 and a bottom 29. Cup deflector 15 is hingedly attached to support member 31 located behind back wall 21 adjacent side wall 23. Cup deflector 15 is a relatively planar member suitably formed to receive a disposable cup and to keep the cup in an upright position after the cup is dropped into cup station 5. Cup deflector 15 is mounted on support member 31 to extend in a direction towards side wall 25 and the front edge of bottom 29 (see FIG. 4). Cup deflector 15 has an extension 20 extending perpendicular to and adjacent where the deflector is pivotly mounted. Extension 20, when cup deflector 15 is in its cup receiving position, is biased to depress switch 19 due to a force exerted by spring 22 (see FIG. 5). When cup deflector 15 is engaged by mug 3, extension 20 moves away from and releases switch 19. An identical cup deflector 33, is similarly mounted behind back wall 21 adjacent side wall 25 and extends in a direction towards side wall 23 and front edge of bottom 29. Cup deflector 33 in the present embodiment is not designed to be used as a detection means, however, it may be used as such. An opening 35 is defined between cup deflectors 15, 33 in which a disposable cup may be held therein or mug 3 may be inserted.

When mug 3 is inserted (FIG. 3), cup deflectors 15, 33 are forced in a direction away from mug 3. Extension 20 of cup deflector 15 moves the inverted L-shaped lever 17 of switch 19 in a direction away from switch 19. In its cup receiving position, a switch element 38 is depressed by lever 17 due to the engagement of cup deflector 15 to lever 17. Switch 19 is mounted on support member 36 adjacent cup deflector 15 and back wall 21. A first portion 16 of L-shaped lever 17 is pivotly mounted to switch 19 and extends in a direction perpendicular to switch 19 (see FIG. 6). A second portion 18 of L-shaped lever 17 extends at a right angle to first portion 16 and extends in a direction parallel to an edge 37 of switch 19, thereby forming the inverted L-shaped member. The switch element 38 is located within and depressed by second portion 18 of lever 17 and is released when the lever is moved by cup deflector 15. Upon releasing switch element 38, a signal is sent to microprocessor 39 which instructs cup dispenser 11 not to drop a disposable cup into cup station 5. From this it follows that beverage dispenser 9 will fill mug 3 as it would fill a disposable cup.

Figure 7:
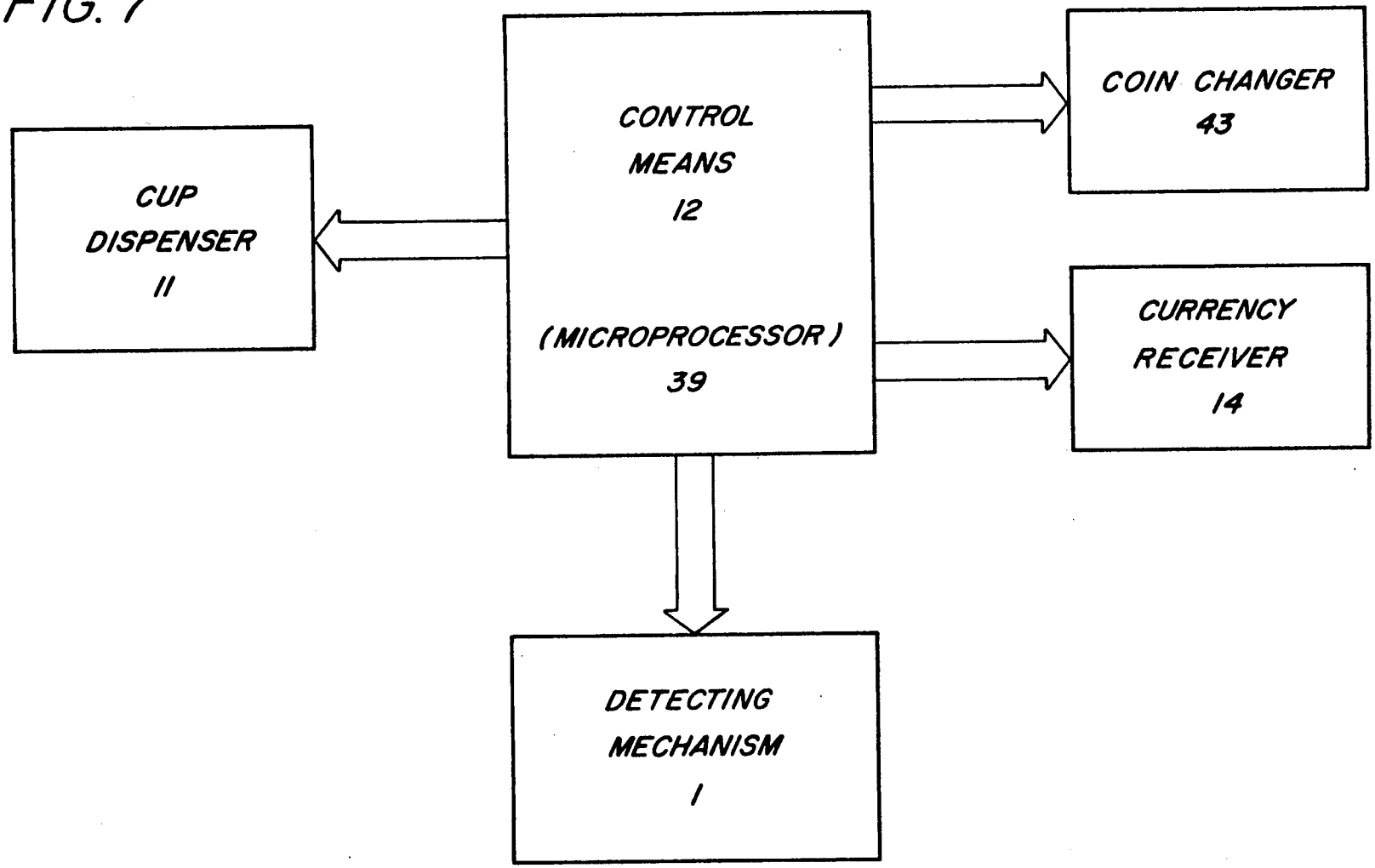
FIG. 7 is a block diagram showing a control means.

In the default program of microprocessor 39, upon satisfying a predetermined amount of currency, it instructs cup dispenser 11 to drop a disposable cup into cup station 5 (FIG. 7). In order to activate detecting mechanism 1, a purchaser must place mug 3 into cup station 5 before depositing money into currency receiver 14 and selecting a beverage (FIG. 1). The placement of mug 3 in cup station 5 sends a signal to microprocessor 39 to override the default instruction. Concurrent with and independent from this instruction, is an instruction to coin changer 43 to reduce the purchase price and to remit to the purchaser a discount for opting to use mug 3. Alternatively, the predetermined amount of currency may be lowered, thus the purchaser deposits less currency in receiver 14 than he otherwise would have. Upon receiving the overriding signal from switch 19, microprocessor 39 will also instruct coin changer 43 that a preprogrammed discount price will activate beverage dispenser 9. Therefore, one does not have to pay the same price as a purchaser who opts to receive the disposable cup that automatically is dispensed.

The operation of detecting mechanism 1 is as follows. Before money is deposited in receiver 14, a purchaser places mug 3 into cup station 5. By inserting mug 3, cup deflector 15 is pivoted to move upon engagement of the mug in a direction away from the mug. Cup deflector 15 in turn engages and moves in the same general direction lever 17. Lever 17 thereby releases switch element 38 which sends a signal to microprocessor 39 instructing cup dispenser 11 to not drop a disposable cup into cup station 5. The same signal through microprocessor 39 also instructs coin changer 43 to remit a monetary discount to the purchaser who substituted mug 3 in place of the disposable cup that is normally dropped into cup station 5.

In view of the above, it will be seen that the several objects of the invention are achieved and other advantageous results attained.

As various changes could be made in the above constructions without departing from the scope of the invention, it is intended that all matter contained in the above description as shown in the accompanying drawing shall be interpreted as illustrative and not in a limiting sense.

What is claimed is:

1. In a beverage dispensing machine of the type having a cup station, means for holding a plurality of cups, means for delivering one of said cups at a time to the cup station, means for dispensing beverage to the cup station, and control means for controlling operation of said cup delivery means and said beverage dispensing means, said control means being adapted to initiate a cycle of operation of the machine upon activation of said control means wherein said cup delivery means delivers a cup to the cup station from said cup holding means and said beverage dispensing means dispenses a predetermined quantity of beverage to the cup in the cup station, wherein the improvement comprises means engageable with a container inserted into the cup station for detecting the presence of the container prior to activation of said control means, said detecting means being operable to modify said cycle of operation of the machine such that upon activation of said control means said cup delivery means does not deliver a cup to said cup station and said beverage dispensing means dispenses said predetermined quantity of beverage to the container inserted in the cup station.

2. A beverage dispensing machine as set forth in claim 1 wherein said detecting means comprises a member engageable with the container and movable upon engagement with the container to an activated position wherein said beverage dispensing means dispenses beverage to the container in the cup station.

3. A beverage dispensing machine as set forth in claim 2 wherein said detecting means further comprises a switch, said member being hingedly connected to a support to be pivoted by engagement with said container in a direction away from said container when said container is placed in said cup station, upon being pivoted, said member releases said switch whereby a signal is sent to said control means for preventing the dispensing of said disposable cup into said cup station.

4. A beverage dispensing machine as set forth in claim 3 wherein said control means comprises a microprocessor located within said vending machine.

5. A beverage dispensing machine as set forth in claim 1 wherein said control means further comprises a currency receiving device, said control means being adapted to activate said cycle of operation of the machine upon insertion of a predetermined amount of currency therein, the currency receiving device being adapted to either refund a portion of said predetermined amount of currency upon detection by said detecting means of a container inserted into the cup station, or lower said predetermined amount of currency.

6. In a beverage dispensing machine of the type having a cup station, means for holding a plurality of cups, means for delivering one of said cups at a time to the cup station, means for dispensing beverage to the cup station, and control means for controlling operation of said cup delivery means and said beverage dispensing means, said control means being adapted to initiate a cycle of operation of the machine upon activation of said control means wherein said cup delivery means delivers a cup to the cup station from said cup holding means and said beverage dispensing means dispenses a predetermined quantity of beverage to the cup in the cup station, wherein the improvement comprises means for engaging and detecting the presence of a container inserted into the cup station prior to activation of said control means, said container engagement and detecting means being adapted to modify said cycle of operation of the machine such that upon activation of said control means said cup delivery means does not deliver a cup to said cup station and said beverage dispensing means deliver said predetermined quantity of beverage to the container inserted in the cup station, and a means for remitting a discount wherein said control means includes a currency receiving device, said control means being adapted to activate said cycle of operation of the machine upon insertion of a predetermined amount of currency therein, the currency receiving device being adapted to either refund a portion of said predetermined amount of currency upon detection by said engaging and detecting means of a container inserted into the cup station, or lower said predetermined amount of currency.

7. A beverage dispensing machine as set forth in claim 6 wherein said engaging and detecting means comprises a member engageable with the container and movable upon engagement with the container to an activated position wherein said beverage dispensing means dispenses beverage to the container in the cup station.

8. A beverage dispensing machine as set forth in claim 7 wherein said engagement member includes a pivotable member and a switch, said member being hingedly connected to a support to be pivoted by engagement with said container in a direction away from said container when said container is placed in said cup station, upon being pivoted, said member releases said switch whereby a signal is sent to said control means for preventing the dispensing of said disposable cup into said cup station.

9. A beverage dispensing machine as set forth in claim 8 wherein said control means includes a microprocessor located within said vending machine, whereby said microprocessor instructs said cup supply to not drop said disposable cup to said cup station when a container is placed in said cup station.

* * * * *